US007575695B2

(12) United States Patent
Foister et al.

(10) Patent No.: US 7,575,695 B2
(45) Date of Patent: Aug. 18, 2009

(54) ADDITIVES PACKAGE AND MAGNETORHEOLOGICAL FLUID FORMULATIONS FOR EXTENDED DURABILITY

(75) Inventors: Robert T. Foister, Rochester Hills, MI (US); Vardarajan R. Iyengar, Macomb, MI (US); Sally M. Yurgelevic, Eastpointe, MI (US)

(73) Assignee: Delphi Technologies, Inc., Troy, MI (US)

( * ) Notice: Subject to any disclaimer, the term of this patent is extended or adjusted under 35 U.S.C. 154(b) by 205 days.

(21) Appl. No.: 11/623,828

(22) Filed: Jan. 17, 2007

(65) Prior Publication Data

US 2007/0170392 A1 Jul. 26, 2007

Related U.S. Application Data

(60) Provisional application No. 60/743,149, filed on Jan. 20, 2006.

(51) Int. Cl.
*H01F 1/44* (2006.01)

(52) U.S. Cl. ..... 252/62.52; 252/405; 252/406; 252/400.54

(58) Field of Classification Search ..... 252/62.52, 252/400.54, 406, 405
See application file for complete search history.

(56) References Cited

U.S. PATENT DOCUMENTS 3,356,702 A 12/1967 Farmer et al.
4,098,705 A 7/1978 Sakurai et al.
4,648,985 A * 3/1987 Thorsell et al. ..... 508/364
5,627,146 A 5/1997 Tanaka et al.
5,683,615 A 11/1997 Munoz
5,840,672 A 11/1998 Gatto
5,879,580 A 3/1999 Tsuda et al.
5,885,942 A * 3/1999 Zhang et al. ..... 508/184
6,531,428 B2 3/2003 Nakazato et al.
6,592,772 B2 7/2003 Foister et al.
6,599,439 B2 7/2003 Iyengar et al.
6,638,443 B2 10/2003 Iyengar et al.
6,787,058 B2 9/2004 Foister et al.
6,806,241 B2 * 10/2004 Karol et al. ..... 508/273
6,824,700 B2 11/2004 Iyengar et al.
2005/0173669 A1 8/2005 Kurata et al.

FOREIGN PATENT DOCUMENTS

WO WO/02/25674 3/2002

OTHER PUBLICATIONS

European Search Report dated Jun. 18, 2007.

* cited by examiner

*Primary Examiner*—C. Melissa Koslow
(74) *Attorney, Agent, or Firm*—Thomas N. Twomey

(57) ABSTRACT

An additives package for use in an MR fluid formulation is provided, as well as an MR fluid formulation containing the additives package. In one embodiment, the additives package comprises an organomolybdenum dithiocarbamate, an ashless dithiocarbamate, and a triazole compound, such as a tolutriazole compound. In another embodiment, the additives package may further include an aminic antioxidant, such as an alkylated diphenylamine. In another embodiment, the additives package is free of an organomolybdate ester. In another embodiment, the additives package consists of the organomolybdenum dithiocarbamate, the ashless dithiocarbamate, the triazole compound, and optionally the aminic antioxidant. In addition to the additives package, the magnetorheological fluid formulation comprises magnetizable particles, a carrier fluid, and a thickening agent.

23 Claims, 2 Drawing Sheets

ADDITIVES PACKAGE AND MAGNETORHEOLOGICAL FLUID FORMULATIONS FOR EXTENDED DURABILITY

CROSS REFERENCE TO RELATED APPLICATION

Pursuant to 37 C.F.R. § 1.78(a)(4), this application claims the benefit of and priority to prior filed Provisional Application Ser. No. 60/743,149, filed Jan. 20, 2006, which is expressly incorporated herein by reference.

FIELD OF THE INVENTION

This invention relates to magnetorheological (MR) fluids, and more specifically, to MR fluids having extended durability.

BACKGROUND OF THE INVENTION

Magnetorheological (MR) fluids are substances that exhibit an ability to change their flow characteristics by several orders of magnitude and in times on the order of milliseconds under the influence of an applied magnetic field. The utility of these materials is that suitably configured electromechanical actuators that use a MR fluid can act as a rapidly responding active interface between computer-based sensing or controls and a desired mechanical output. With respect to automotive applications, such materials are seen as a useful working media in shock absorbers, for controllable suspension systems, vibration dampers in controllable power train and engine mounts, and in numerous electronically controlled force/torque transfer (clutch) devices.

MR fluids are non-colloidal suspensions of finely divided (typically one to 100 micron diameter) low coercivity, magnetizable solids such as iron, nickel, cobalt, and their magnetic alloys dispersed in a base carrier liquid such as a mineral oil, synthetic hydrocarbon, water, silicone oil, esterified fatty acid or other suitable organic liquid. MR fluids have an acceptably low viscosity in the absence of a magnetic field but display large increases in their dynamic yield stress when they are subjected to a magnetic field of, e.g., about one Tesla. The iron particles are kept suspended in the liquid by the action of a thixotrope or anti-settling agent. Special additives are also used to reduce oxidation of the base fluid and iron particles, reduce friction, reduce wear, and improve durability.

In the context of automotive applications, MR fluids have been developed to pass shock absorber durability testing, while minimizing settling and in-use thickening. This has largely been accomplished by careful specification of components of the formulation. For example, prior art fluids have used particular types of magnetizable particles and/or particular types of thickening agents to provide consistent properties and to minimize settling of the MR fluid over its life. In addition, typical prior art MR fluids contain additives, such as organomolybdenums, zinc dialkyl dithiophosphate (ZDDP), thiocarbamates, and phosphorous-containing compounds in low concentration (about 1-2%) to minimize in-use thickening and reduce wear of mechanical components.

First generation (Gen1) MR fluids generally have an operating temperature range of −40-70° C., with excursions up to 105° C. The second generation (Gen2) and third generation (Gen3) MR fluids require a wider operating temperature range, specifically −40° C.-130° C. continuous exposure, with up to 150° C. excursions. The Gen2 MR fluids require 25% higher on-state forces, and the Gen3 MR fluids require 100% higher on-state forces. Both the Gen2 and Gen3 MR fluids require a 25% decrease in off-state forces. These requirements must be met without any compromise in durability and settling performance.

While the Gen1, Gen2 and Gen3 fluids pass the standard durability test, the fluids do exhibit varying degrees of thickening at the end of the test. This is evidenced by the fact that at the end of the test, current MR fluids exhibit increases in off-state damping force (measured at 0.25 m/s piston velocity) of around 10% (Gen1), 15% (Gen3) and 30% (Gen2), on average. While these force increases are within the prescribed limit of 50% (at 0.25 m/s piston velocity), it is evident that the performance of these fluids may deteriorate if the test were to proceed beyond the standard limits. As performance demands increase, it is likely that our MR fluids will be required to pass an extended durability test in the near future. Therefore, it is very important to develop new MR fluids that exhibit significantly extended durability performance.

The additives in the MR fluid significantly influence the durability performance of the fluid in shock absorbers, although the precise mechanism by which these additives protect the fluid is not well understood. Consequently, additives that are currently being used in MR fluids have been developed by a trial-and-error method, and the first additive package that provides adequate performance in the durability test has been used without further refinement or optimization. This is primarily due to the fact that durability testing is expensive and time- and resource-intensive.

The present inventors have conducted extensive analytical tests on unused and post-durability MR fluids. The results of these analyses indicate that the durability performance of Gen3 MR fluids is strongly correlated to the level of the antioxidant additive in the MR fluid. The results further indicate that once the level of antioxidant decreases below a critical level, the fluid exhibits thickening, which manifests itself as an increase in off-state damping force.

There is thus a need to develop a MR fluid formulation that has extended durability, and more specifically, there is a need to develop a combination of additives for an MR fluid that prevents fluid thickening for extended durability testing.

SUMMARY OF THE INVENTION

The present invention provides an additives package for use in an MR fluid formulation, comprising an organomolybdenum dithiocarbamate, an ashless dithiocarbamate, and a triazole compound, such as a tolutriazole compound. In one embodiment, the additives package may further include an aminic antioxidant, such as an alkylated diphenylamine. In another embodiment, the additives package is free of an organomolybdate ester. In another embodiment, the additives package consists of an organomolybdenum dithiocarbamate, an ashless dithiocarbamate, a triazole compound, such as a tolutriazole compound, and optionally an aminic antioxidant, such as an alkylated diphenylamine.

The present invention further provides a magnetorheological fluid formulation comprising magnetizable particles, a carrier fluid, a thickening agent and an additives package, as discussed above. The organomolybdenum dithiocarbamate may be present in an amount of about 0.0025 to about 2.5% by weight of the formulation, for example, in an amount of about 0.05 to about 1% by weight of the formulation. The ashless dithiocarbamate may be present in an amount of about 0.0025 to about 2.5% by weight of the formulation, for example, in an amount of about 0.05 to about 1% by weight of the formulation. The triazole compound may be present in an amount of about 0.0025 to about 2.5% by weight of the formulation, for example, in an amount of about 0.01 to about 0.1% by weight of the formulation. The aminic antioxidant, such as an alkylated diphenylamine, may be present in an amount up to about 2.5% by weight of the formulation, for example, in an amount of about 0.0025 to about 2.5% by weight of the formulation, and by further example, in an amount of about 0.01 to about 0.1% by weight of the formulation. The magnetizable particles may be present in an amount of about 50 to about 95% by weight of the formulation. The carrier fluid may be present in an amount of about 5 to about 50% by weight of the formulation. The thickening agent may be present in an amount of about 0.025 to about 10% by weight of the formulation. In another embodiment, the total level for the additives package may be at least about 0.05% by weight of the formulation, for example, at least about 0.1%. In another embodiment, the total level for the additives package may be no more than about 5% by weight of the formulation, for example, no more than about 2.2%.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Current Gen3 fluids, i.e., those of the prior art, generally fail in extended durability testing due to large increases in off state damping loads, and thus will not meet future standards for MR fluids. Future standards for extended lifetime of MR fluids will require that the fluids pass an extended durability test while maintaining acceptable increases in off state forces, and an operating temperature with a maximum in the range of about 130-150° C.

The mechanism of thickening, and thus failure, is believed to be a sequential and multifaceted process initiated by chemical oxidation and breakdown of fluid phase components, i.e., breakdown of the liquid carrier. This process is promoted by wear of damper (e.g., shock absorber) components, such as the flux ring and the damper tube, which generates metallic fines that serve as catalytic sites for free radical formation. The breakdown of the liquid carrier and the resulting thickening of the MR fluid is further accelerated by increases in temperature and side load. The inventors herein have thus identified that the initiation of thickening in an MR Fluid can be controlled by the type and level of the antioxidant(s) in the fluid. Oxidation stability can be studied by means of many standard tests such as RBOT, TEOST, PDSC, and TFOUT. We have used high pressure DSC, per ASTM D6186 to study the oxidative stability of MR fluids.

Figure 1:
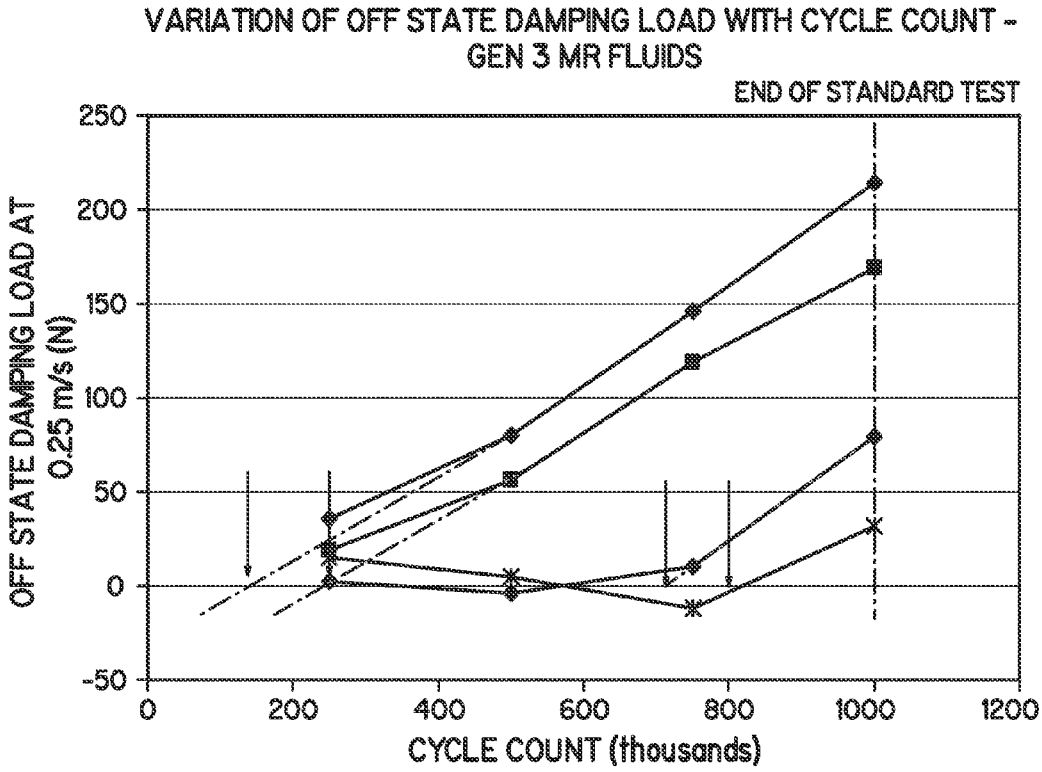
FIG. 1 is a plot of the variation in off-state damping load with cycle count after the initiation of thickening in prior art MR fluids.

To arrive at the conclusion that the oxidative stability of MR fluids can be improved by controlling the type and level of the antioxidant(s), the present inventors conducted extensive analytical tests on unused and post-durability MR fluids, as stated above. FIG. 1 shows the durability performance of four shock absorbers containing different versions of Gen3 MR fluids, each including the same additives package of the prior art, specifically a package containing organomolybdenum thiocarbamate and ashless thiocarbamate. Mainly, the fluids contained differences in the type or quantity of the magnetizable particles. The arrows in FIG. 1 show the cycle count at the onset of thickening. It can be seen that fluids that have a larger number of cycles between the initiation of thickening and the end of the test perform poorly (larger force increase by end of test) compared to those fluids that have a shorter cycle count between the initiation of thickening and the end of the test.

Figure 2:
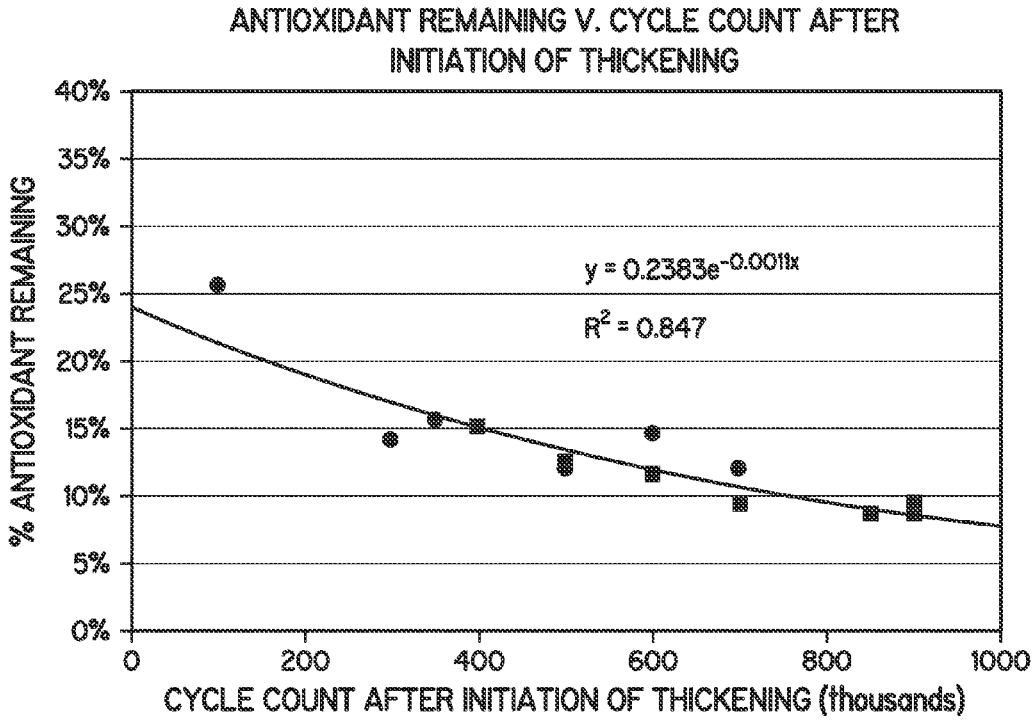
FIG. 2 is a plot depicting antioxidant depletion during durability testing of prior art MR fluids.

FIG. 2 shows the correlation between level of antioxidant present in the post-durability fluid and the number of cycles between initiation of fluid thickening and the end of the test. Fluids that performed better, i.e., those that exhibited low force increase and a low cycle count between initiation of thickening and end of test also had higher levels of the antioxidant present in the post-durability fluid. Since the antioxidant level remaining at the end of the test is related to oxidative stability of the fluid, this implies that the oxidative stability of an MR fluid may be correlated to durability performance. While oxidation is one of many degradative processes that can occur inside the damper, it is likely that oxidation precedes and possibly initiates the degradative processes that lead to fluid thickening. Consequently, stability to oxidation may be a strong indicator of durability performance. Thus, the results indicated that the durability performance of MR fluids is strongly correlated to the level of the antioxidant additive in the MR fluid, and once the level of antioxidant decreases below a critical level, the fluid exhibits thickening, including an increase in viscosity and yield stress which further manifests itself as an increase in off state damping load.

In view of this correlation, the present inventors investigated the types and levels of antioxidants used in an additives package. In accordance with the present invention, it has been found that the oxidative stability of MR fluids, such as a Gen3 fluid, can be significantly improved by the use of a combination of additives, also referred to as an antioxidant additives package, that includes: 1) an organomolybdenum dithiocarbamate, 2) an ashless dithiocarbamate, and 3) a triazole compound, such as a tolutriazole compound. The term "ashless" refers to the absence of a metal in the compound, i.e., the dithiocarbamate is free of metal atoms. A further improvement of the oxidative stability can be achieved by the addition of 4) an aminic antioxidant, such as an alkylated diphenylamine. The components in the additives package of the present invention will now be described.

Organomolybdenum Dithiocarbamate

Organomolybdenum dithiocarbamate is a friction reduction agent with some antioxidant capability in the MR fluid. U.S. Pat. Nos. 3,356,702, 4,098,705 and 5,627,146, each of which is incorporated herein by reference in its entirety, describe the structure of molybdenum dithiocarbamates. These compounds are characterized by the formula:

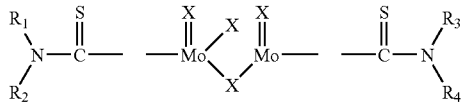

where $R_1$-$R_4$ are alkyl or aryl groups, branched or straight-chained, same or different, and contain between 1 and 22 C atoms, with an exemplary embodiment being 8 to 13 C atoms.

X can be sulfur or oxygen. The S to Mo mole ratio is between 2 and 3, with an exemplary embodiment being 2.5 to 2.8, and a further exemplary embodiment being 2.6 to 2.75. An exemplary molybdenum thiocarbamate is MOLYVAN® 822, manufactured by R. T. Vanderbilt Company, Norwalk, Conn.

Ashless Dithiocarbamate

An ashless thiocarbamate is an antioxidant and extreme pressure agent in MR fluids. An ashless thiocarbamate was described in U.S. Pat. No. 4,648,985, the entire content of which is incorporated herein by reference. These compounds may be characterized by the formula:

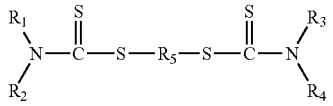

where $R_1$-$R_4$ are the same or different, and are H or a hydrocarbon having between 1 and 22 C atoms, for example, $R_1$-$R_4$ are aliphatic or aromatic having 4 to 18 C atoms, and by further example, $R_1$-$R_4$ are branched alkyl or aryl compounds containing 4 to 12 C atoms. $R_5$ is a hydrocarbon having 1 to 8 C atoms, for example, an aliphatic containing 1 to 5 C atoms, and by further example, an alkyl containing 1 or 2 C atoms. An example of an exemplary ashless dithiocarbamate is methylene bis-dibutyl dithiocarbamate. This compound is commercially available under the name VANLUBE® 7723 from the R. T. Vanderbily Company of Norwalk, Conn.

A dithiocarbamate having a single functional group also may be used. The compound is characterized by the following formula:

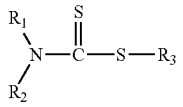

where $R_1$-$R_2$ are as defined above, $R_3$ is a hydrocarbon having 1 to 8 C atoms, for example, an aliphatic containing 1 to 5 C atoms, and by further example, an alkyl containing 1 or 2 C atoms, and in addition $R_3$ may be an amine containing 1 to 22 C atoms.

Triazole Compounds

Triazole compounds are an antioxidant and sludge formation inhibitor in MR fluids, including effectiveness as a copper corrosion inhibitor. Examples of triazole compounds include: benzotriazoles and derivatives thereof, e.g., 4- or 5-alkylbenzotriazoles (e.g., tolutriazole) and derivatives thereof; 4,5,6,7-tetrahydrobenzotriazole; 5,5'-methylenebis-benzotriazole; Mannich bases of benzotriazole or tolutriazole, such as 1-[di(2-ethylhexyl)aminomethyl]-tolutriazole and 1-[di(2-ethylhexyl)aminomethyl]-benzotriazole; alkoxyalkylbenzotriazoles, such as 1-(nonyloxymethyl)-benzotriazole, 1-(1-butoxyethyl)-benzotriazole and 1-(1-cyclohexyloxybutyl)-tolutriazole. Exemplary triazole compounds are tolutriazole compounds, such as VANLUBE® 887 and VANLUBE® 887E, both manufactured by R. T. Vanderbilt Company of Norwalk, Conn.

Aminic Antioxidants

Aminic antioxidants, such as alkylated diphenylamines, function as free radical scavengers and provide antioxidant properties in MR fluids. Examples of aminic antioxidants include the following: N,N'-di-isopropyl-p-phenylenediamine; N,N'-di-sec-butyl-p-phenylenediamine; N,N'-bis(1,4-dimethyl-pentyl)-p-phenylenediamine; N,N'-bis(1-ethyl-3-methyl-pentyl)-p-phenylenediamine; N,N'-bis(1-methyl-heptyl)-p-phenylenediamine; N,N'-dicyclohexyl-p-phenylenediamine; N,N'-diphenyl-p-phenylenediamine; N,N'-di(naphth-2-yl)-p-phenylenediamine; N-isopropyl-N'-phenyl-p-phenylenediamine; N-(1,3-dimethyl-butyl)-N'-phenyl-p-phenylenediamine; N-(1-methyl-heptyl)-N'-phenyl-p-phenylenediamine; N-cyclohexyl-N'-phenyl-p-phenylenediamine; 4-(p-toluene-sulfonamido)-diphenylamine; N,N'-dimethyl-N,N'-di-sec-butyl-p-phenylenediamine; diphenylamine; N-allyldiphenylamine; 4-isopropoxy-diphenylamine; N-phenyl-1-naphthylamine; N-(4-tert-octylphenyl)-1-naphthylamine; N-phenyl-2-naphthylamine; octylated diphenylamine, e.g., p,p'-di-tert-octyl-diphenylamine; 4-n-butylaminophenol; 4-butyrylamino-phenol; 4-nonanoylamino-phenol; 4-dodecanoylamino-phenol; 4-octadecanoylamino-phenol; di(4-methoxyphenyl) amine; 2,6-di-tert-butyl-4-dimethylamino-methyl-phenol; 2,4'-diamino-diphenylmethane; 4,4'-diamino-diphenyl-methane; N,N,N',N'-tetramethyl-4,4'-diamino-diphenyl-methane; 1,2-di[(2-methyl-phenyl)-amino]ethane; 1,2-di (phenylamino)propane; (o-tolyl)-biguanide; di[4-(1',3'-dimethyl-butyl)-phenyl]amine; tert-octylated N-phenyl-1-naphthylamine; mixture of mono- and di-alkylated tert-butyl-/tert-octyl-diphenylamines; mixture of mono- and di-alkylated dodecyldiphenylamines; mixture of mono- and di-alkylated isopropyl-/isohexyldiphenylamines; mixtures of mono- and di-alkylated tert-butyldiphenylamines; 2,3-dihydro-3,3-dimethyl-4H-1,4-benzothiazine; phenothiazine; mixture of mono- and di-alkylated tert-octyl-phenothiazines; N-allylphenothiazine; N,N,N',N'-tetraphenyl-1,4-diaminobut-2-ene; N,N-bis(2,2,6,6-tetramethyl-piperidin-4-yl) hexamethylenediamine; bis(2,2,6,6-tetramethylpiperidin-4-yl)sebacate; 2,2,6,6-tetramethylpiperidin-4-one; and 2,2,6,6-tetramethylpiperidin-4-ol.

Exemplary aminic antioxidants are alkylated diphenylamines, such as VANLUBE® 961 (butylated/octylated diphenylamines), VANLUBE® SL (octylated diphenylamine), VANLUBE® 81 (para dioctylated diphenylamine), VANLUBE® 2005 (nonylated diphenylamine) and VANLUBE® NA (para nonylated ortho ethylated diphenylamine).

Optionally, commercially available additives packages that contain a combination of the above additive compounds may be incorporated into the MR fluid together with the remaining additive compounds. One exemplary additive combination package is one that contains methylene bis-dibutyl dithiocarbamate and a tolutriazole compound in the weight ratio of 85% and 15% respectively, and is available commercially under the tradename VANLUBE® 996E by R. T. Vanderbilt Company of Norwalk, Conn., USA. This package can then be combined with an organomolybdenum dithiocarbamate, such as MOLYVAN® 822 and optionally an aminic antioxidant, such as VANLUBE® 961.

The invention will now be explained in reference to an exemplary application in an MR fluid formulation, specifically an MR fluid for use in a shock absorber in a vehicle. It should be understood, however, that the additives package of the invention applies to any MR fluid formulation regardless of the fluid's application.

The magnetizable particles in the MR fluid formulation of the present invention are magnetizable ferromagnetic, low coercivity (i.e., little or no residual magnetism when the magnetic field is removed), finely divided particles, and may include any known particle type for MR fluids, including iron, iron oxides, carbonyl iron, atomized iron, high-pressure water-atomized iron, stainless steel, atomized stainless steel, nickel, cobalt, vanadium, manganese, or alloys thereof. Generally, the magnetizable particles comprise 50-95 wt. % of the MR fluid, with 20 wt. % being exemplary. In an exemplary embodiment, the particles are spherical or nearly spherical in shape and have a diameter in the range of about 1 to 100 μm, for example, about 5 to about 20 μm. Because the particles are employed in non-colloidal suspensions, it may be advantageous for the particles to be at the small end of the suitable range. The magnetizable particles may also have a bimodal size distribution, such as that described in U.S. Pat. No. 5,667,715, commonly owned, and incorporated by reference herein in its entirety. For example, the magnetizable particles may be a mixture of spherical particles in the range of 1 to 100 μm in diameter with two distinct particle size members present, one a relatively large particle size that is 5 to 10 times the mean diameter of the relatively small particle size component. In another exemplary embodiment, the particles may be iron powder having a passivating oxide layer thereon, produced by a controlled, water atomization process and having a smooth, generally spherical shape, a narrow size distribution, and a mean diameter in the range of about 8-25 μm, as described in U.S. Pat. No. 6,787,058, commonly owned, and incorporated by reference herein in its entirety. In yet another exemplary embodiment, the magnetizable particles may also be atomized magnetic stainless steel particles as disclosed in U.S. Pat. No. 6,679,999, commonly owned, and incorporated by reference herein in its entirety.

The liquid vehicle or liquid carrier phase is used to suspend the magnetizable particles, but does not otherwise react with the particles. The liquid vehicle may be mineral oil, synthetic hydrocarbons, esters, diesters, silicone oils, and/or glycols. In one embodiment, the liquid carrier is a combination of a synthetic hydrocarbon and a synthetic diester. Hydrocarbon liquids include but are not limited to mineral oils, vegetable oils, and synthetic hydrocarbons. Polyalphaolefin (PAO) is a suitable base hydrocarbon liquid for shock absorbers as well as many other MR fluid applications in accordance with this invention. However, the polyalphaolefin may not have suitable lubricant properties for some applications, such that the PAO may used in mixture with known lubricant liquids, such as liquid synthetic diesters. Examples of diester liquids include dioctyl sebacate (DOS) and alkyl esters of tall oil type fatty acids. Methyl esters and 2-ethyl hexyl esters have also been used.

By way of example and not limitation, silicone-based liquid carriers may include silicone oil and/or a silicone copolymer. For example, the fluid may be low viscosity silicone oil having a viscosity of 10-200 cSt (at 25° C.), such as Dow Corning 200 Fluid or Syltherm 800 fluid, each from Dow Corning Co. Glycol liquid carriers may include propylene glycols and/or ethylene glycols, for example.

The magnetizable particles are kept in suspension by dispersing a thickening agent (or thickener) in the liquid vehicle. The thickening agent may include polymeric thickeners, such as high molecular weight hydrocarbons, polyureas, alkali soaps, etc., and/or finely divided solids, such as fumed silica, precipated silica or colloidal clay (organoclay). The thickening agent aims to prevent separation of the liquid and solid phases by forming a thixotropic network that "traps" or suspends the heavier solid in the lighter liquid.

In an exemplary embodiment of the present invention, an MR fluid formulation comprises about 50-95% by weight magnetizable particles, about 5-50% by weight liquid carrier, about 0.025-10% by weight of one or more thickeners, such as organoclays, fumed silicas, precipated silicas, polyureas, and/or alkali soaps, and an additive package. The additives package may comprise a total of at least about 0.05% by weight of the formulation, and a total of no more than about 5% by weight of the formulation. The additives package includes about 0.0025-2.5% by weight of each of an organomolybdenum dithiocarbamate, an ashless dithiocarbamate, and a tolutriazole compound, and up to about 2.5% by weight of an aminic antioxidant, such as an alkylated diphenylamine.

In a further exemplary embodiment, the additives package includes about 0.05 to about 1% by weight of an organomolybdenum dithiocarbamate, about 0.05 to about 1% by weight of an ashless dithiocarbamate, about 0.05 to about 1% by weight of a tolutriazole compound, and about 0.01 to about 0.1% by weight of an alkylated diphenylamine, and the additives package may comprise a total of at least about 0.1% by weight of the formulation, and a total of no more than about 2.2% by weight of the formulation.

In another further exemplary embodiment, the magnetizable particles may be of spherical or near-spherical morphology, with a mean diameter of between about 1 and about 100 μm, for example between about 5 and about 20 μm.

Using high pressure DSC, per ASTM D6186, the present inventors studied the oxidative stability of four MR fluids, as described in Table 1:

TABLE 1

| Sample | Additive Pack | Oxidation Induction Time, min |
|---|---|---|
| Comparative Sample 1: Gen3 MR Fluid Without Additives Package | None | 8 |
| Comparative Sample 2: Gen3 MR Fluid With Prior Art Additives Package | Organomolybdenum Thiocarbamate + Ashless Thiocarbamate | 43 |
| Test Sample 1: Gen3 MR Fluid With Additive Package A of the Present Invention | Organomolybdenum Thiocarbamate + Ashless Thiocarbamate + Tolutriazole compound | 83 |
| Test Sample 2: Gen3 MR Fluid With Additive Package B of the Present Invention | Organomolybdenum Thiocarbamate + Ashless Thiocarbamate + Tolutriazole compound + Alkylated Diphenylamine | 120 |

The Comparative Sample 1, containing no additive package, performed most poorly in that it exhibited the earliest induction of oxidation. This fluid would be expected to exhibit a very early onset of thickening, a high cycle count between initiation of thickening and the end of a durability test, and a high off state damping load at the end of a durability test, if the fluid even survives the durability test, i.e., does not experience early failure. The Comparative Sample 2, containing only the organomolybdenum thiocarbamate and ashless thiocarbamate in the additives package, achieved only modest improvement with respect to the induction of oxidation. This fluid would be expected to behave similarly to those in FIG. 1 and FIG. 2 with respect to the onset of thickening, the number of cycles between initiation of thickening and the end of the test, and the off state damping load at the end of the test. The Test Samples 1 and 2 of the present invention, on the other hand, exhibited significant improvement in oxidative stability compared to Comparative Sample 2. The time elapsed until the induction of oxidation improved by a factor of 2 compared to Comparative Sample 2 as a result of Additives Package A of the present invention, and by a factor of 3 compared to Comparative Sample 2 as a result of Additives Package B of the present invention. Test Samples 1 and 2 would be expected to show a significant delay in the onset of thickening in the MR fluid and a low off sate damping load at the end of the 1 million cycle test. It is further expected that Test Samples 1 and 2 are capable of passing a 1.5 million cycle durability test.

Figure 3:
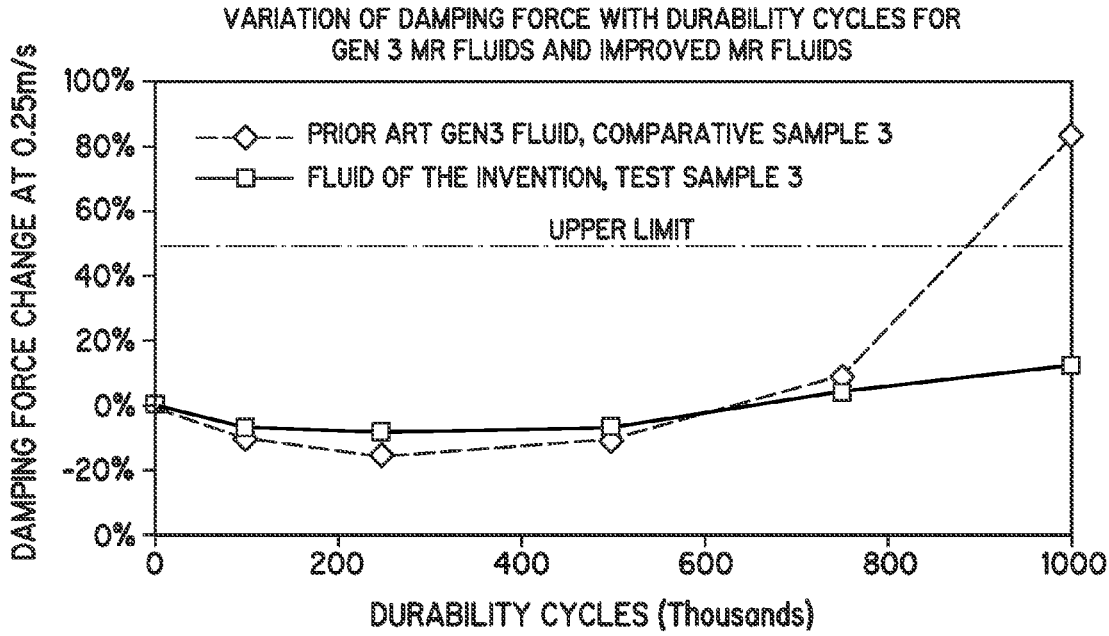
FIG. 3 is a plot of the variation in off-state damping force with cycle count for an MR fluid of the invention compared to a prior art MR fluid.

FIG. 3 shows the variation of the off-state damping force (at 0.25 m/s piston velocity) as a function of the number of durability cycles completed for dampers containing one of two MR fluids. The dashed line represents the average performance of 8 dampers containing a Gen3 MR fluid (26% magnetizable particle content) with the prior art antioxidant additives package (organomolybdenum thiocarbamate+ashless thiocarbamate), referred to as Comparative Sample 3. The solid line represents the average performance of 4 dampers containing an MR fluid of the invention, referred to as Test Sample 3, namely the same fluid and particle content as the Gen3 fluid of Comparative Sample 3 but substituting an antioxidant additive package of the invention (organomolybdenum thiocarbamate+ashless thiocarbamate+tolutriazole compound+alkylated diphenylamine). The horizontal dotted line indicates an increase in damping force of 50% and represents the acceptable upper limit for damper force increase at a piston velocity of 0.25 m/s. It can be seen from the plot that the two curves are nearly identical for the first 750,000 durability cycles. However, beyond this mark, the prior art Gen3 MR fluid (Comparative Sample 3) exhibits a rapid increase in damping force, and exceeds the acceptable limit of 50% at 1 Million cycles of durability testing. The MR fluid of the invention (Test Sample 3) exhibits a small increase in damping force of around 15% at 1M durability cycles, which is well below the limit. Thus, the MR fluid of the invention can be used to provide extended durability in shock absorbers.

It was further found that the incorporation of an organomolybdate ester in the additives package, such as recommended by U.S. Pat. No. 5,683,615, resulted in a significant reduction in oxidative stability, and also in decreased durability performance. Therefore, in one embodiment of the present invention, the additives package, and thus the MR fluid, is free of organomolybdate esters. In another embodiment of the present invention, the additives package, and thus the MR fluid, is free of any antioxidant other than organomolybdenum dithiocarbamates, ashless dithiocarbamates, tolutriazole compounds and alkylated diphenylamines, i.e., the additives package "consists of" only these 4 types of antioxidant components.

One advantage of the present invention is that by using the tolutriazole and/or the alkylated diphenylamine in combination with the organomolybdenum and ashless dithiocarbamates, the efficiency of the antioxidant package is increased, i.e., less total antioxidant may be used to achieve the same or better oxidation performance. Interactions between the additives and the thickening agents, such as organoclays, increase with increasing concentration of the additives, which can lead to decreased efficiency of the thixotropic network formed by the thickening agent. Thus, advantages of using less additive to achieve the same oxidation performance include cost savings and less potential for interactions with other system components.

Oxidation Induction Time (OIT) was measured, in minutes, for the following samples:

MR base liquid+1.5% organomolybdenum dithiocarbamate+1.5% methylene bis(dibutyldithiocarbamate): OIT=70 minutes MR base liquid+3% organomolybdenum dithiocarbamate+1.5% methylene bis(dibutyldithiocarbamate): OIT=111 minutes MR base liquid+1.5% organomolybdenum dithiocarbamate+1.5% (85/15 mixture of methylene bis (dibutyldithiocarbamate) and tolutriazole compound): OIT=106 minutes where the MR base liquid was PAO (2.5 cSt)+DOS in an 80/20 volume ratio. Additive percentages are by weight with respect to the weight of the MR base liquid. No magnetizable particles or thickeners were used in these experiments in order to study the effect of additive synergy and efficiency in a relatively simple system.

A larger OIT is indicative of better oxidation resistance. The data shows that simply replacing a small part (15% by weight) of the methylene bis(dibutyldithiocarbamate) additive with a tolutriazole compound improves oxidation resistance to a level that is only otherwise achieved by doubling the level of one of the original additives.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope of the general inventive concept.

What is claimed is:

1. An additive package for use in an MR fluid formulation, comprising:

an organomolybdenum dithiocarbamate, an ashless dithiocarbamate, an aminic antioxidant, and a triazole compound, with the proviso that the additive package is free of an organomolybdate ester.

2. The additive package of claim 1 wherein the aminic antioxidant is an alkylated diphenylamine.

3. The additive package of claim 1 wherein the ashless dithiocarbamate is methylene bis-dibutyl dithiocarbamate.

4. An antioxidant additive package for use in an MR fluid formulation, consisting of:

an organomolybdenum dithiocarbamate, an ashless dithiocarbamate, a tolutriazole compound, and optionally, an alkylated diphenylamine.

5. The additive package of claim 4 wherein the ashless dithiocarbamate is methylene bis-dibutyl dithiocarbamate.

6. A magnetorheological fluid formulation comprising magnetizable particles, a carrier fluid, a thickening agent and an additives package comprising:

an organomolybdenum dithiocarbamate, an ashless dithiocarbamate, and a triazole compound.

7. The fluid formulation of claim 6, wherein the organomolybdenum dithiocarbamate is present in an amount of about 0.0025 to about 2.5% by weight of the formulation;

the ashless dithiocarbamate is present in an amount of about 0.0025 to about 2.5% by weight of the formulation, and the triazole compound is present in an amount of about 0.0025 to about 2.5% by weight of the formulation.

8. The fluid formulation of claim 7, further comprising an alkylated diphenylamine present in an amount of about 0.0025 to about 2.5% by weight of the formulation.

9. The fluid formulation of claim 7, wherein the magnetizable particles are present in an amount of about 50 to about 95% by weight of the formulation.

10. The fluid formulation of claim 9, wherein the magnetizable particles are of spherical or near-spherical morphology, with mean diameter of between about 1 to about 100 microns.

11. The fluid formulation of claim 10, wherein mean diameter of the magnetizable particles is between about 5 to about 20 microns.

12. The fluid formulation of claim 7, wherein the carrier fluid is present in an amount of about 5 to about 50% by weight of the formulation.

13. The fluid formulation of claim 7, wherein the thickening agent is present in an amount of about 0.025 to about 10% by weight of the formulation.

14. The fluid formulation of claim 6 with the proviso that the fluid formulation is free of an organomolybdate ester.

15. The fluid formulation of claim 6, wherein the ashless dithiocarbamate is methylene bis-dibutyl dithiocarbamate.

16. The fluid formulation of claim 6 wherein the additives package is present in an amount of at least about 0.05% by weight of the formulation.

17. The fluid formulation of claim 6 wherein the additives package is present in an amount of no more than about 5% by weight of the formulation.

18. A magnetorheological fluid formulation comprising magnetizable particles, a carrier fluid, a thickening agent and the additives package of claim 4.

19. The fluid formulation of claim 18, wherein the alkylated diphenylamine is present in an amount of about 0.0025 to about 2.5% by weight of the formulation.

20. A magnetorheological fluid formulation comprising about 50 to about 95% by weight magnetizable particles, about 5 to about 50% by weight of a carrier fluid, about 0.025 to about 10% by weight of a thickening agent, and an additives package, wherein the additives package comprises, based on the total weight of the formulation:

about 0.0025 to about 2.5% by weight of an organomolybdenum dithiocarbamate, about 0.0025 to about 2.5% by weight of an ashless dithiocarbamate, and about 0.0025 to about 2.5% by weight of a tolutriazole compound.

21. The fluid formulation of claim 20, wherein the additive package further comprises about 0.0025 to about 2.5% by weight of an alkylated diphenylamine.

22. The fluid formulation of claim 21 with the proviso that the fluid formulation is free of an organomolybdate ester.

23. The fluid formulation of claim 20 with the proviso that the fluid formulation is free of an organomolybdate ester.

* * * * *